US007654102B2

(12) United States Patent
Hurlebaus et al.

(10) Patent No.: US 7,654,102 B2
(45) Date of Patent: Feb. 2, 2010

(54) AIR TREATMENT SYSTEM FOR REFRIGERATED APPLIANCE

(75) Inventors: Randy W. Hurlebaus, Waunakee, WI (US); Curtis J. Scadden, Waunakee, WI (US); Curtis Leroy Cruver, IV, Elmhurst, IL (US)

(73) Assignee: Sub-Zero, Inc., Madison, WI (US)

( * ) Notice: Subject to any disclaimer, the term of this patent is extended or adjusted under 35 U.S.C. 154(b) by 353 days.

(21) Appl. No.: 11/654,442

(22) Filed: Jan. 17, 2007

(65) Prior Publication Data

US 2008/0168788 A1 Jul. 17, 2008

(51) Int. Cl.
*F25D 17/04* (2006.01)
*A61L 9/20* (2006.01)

(52) U.S. Cl. ..... 62/264; 62/78; 96/223; 96/224; 422/121

(58) Field of Classification Search ..... 96/224, 96/226, 223; 62/78, 264, 314; 422/120–122
See application file for complete search history.

(56) References Cited

U.S. PATENT DOCUMENTS 2,288,587 A * 6/1942 Kalischer ..... 62/227
4,108,363 A 8/1978 Susumu
4,954,465 A 9/1990 Kawashima et al.
4,955,203 A 9/1990 Sundhar
4,955,208 A * 9/1990 Kawashima et al. ..... 62/264
5,006,248 A 4/1991 Anderson et al.
5,035,784 A 7/1991 Anderson et al.
5,062,272 A 11/1991 Burns
5,078,971 A * 1/1992 Matuda et al. ..... 422/121
5,135,645 A 8/1992 Sklenak et al.
5,227,342 A 7/1993 Anderson et al.
5,230,220 A * 7/1993 Kang et al. ..... 62/78
5,836,669 A 11/1998 Hed
5,919,422 A 7/1999 Yamanaka et al.
6,228,502 B1 5/2001 Saitoh et al.
6,286,330 B1 9/2001 Kopf
6,328,937 B1 12/2001 Glazman (Continued)

OTHER PUBLICATIONS

Sub-Zero Design Guide, 3758546 Rev-B, Sep. 2006, 84 pages.

(Continued)

*Primary Examiner*—Michael A Marcheschi
*Assistant Examiner*—Robert A Clemente
(74) *Attorney, Agent, or Firm*—Foley & Lardner LLP

(57) ABSTRACT

A refrigerated appliance is disclosed. The refrigerated appliance comprises an enclosure defining a cooled space and having an outer wall and an inner wall spaced apart from the outer wall to define an air duct. The refrigerated appliance further includes an evaporator disposed at least partially in the air duct and configured to cool air in the air duct, and the evaporator fan is configured to move air from the air duct into the cooled space, and an air treatment system at least partially located in the air duct. A portion of the air passing through the air duct passes through the air treatment system. The air treatment system comprises a filter cartridge or module, a base with a receptacle configured to receive the filter cartridge, and a mounting or coupling mechanism configured to move the filter cartridge into and out of engagement with the base. The mechanism has a release handle such that both the release handle and the cartridge are accessible from the cooled compartment.

23 Claims, 6 Drawing Sheets

U.S. PATENT DOCUMENTS

| | | | | |
|---|---|---|---|---|
| 6,336,998 | B1 | 1/2002 | Wang | |
| 6,346,143 | B1 | 2/2002 | McGowan | |
| 6,581,394 | B1 | 6/2003 | Smolenskiy | |
| 6,606,869 | B2 | 8/2003 | Takahashi et al. | |
| 6,658,884 | B2 * | 12/2003 | Takahashi et al. | 62/264 |
| 6,736,885 | B2 | 5/2004 | Kaiser | |
| 6,865,896 | B2 * | 3/2005 | Kaji et al. | 62/78 |
| 6,866,828 | B2 | 3/2005 | Segawa et al. | |
| 6,918,259 | B2 | 7/2005 | Anderson et al. | |
| 6,923,015 | B2 | 8/2005 | Ueno et al. | |
| 7,040,101 | B2 * | 5/2006 | Takeda et al. | 62/78 |
| 7,056,476 | B2 | 6/2006 | Okada et al. | |
| 7,083,725 | B2 | 8/2006 | Jenkins, Jr. et al. | |
| 7,143,591 | B2 * | 12/2006 | Nonaka et al. | 62/129 |
| 7,377,125 | B2 * | 5/2008 | Seiden et al. | 62/441 |
| 2003/0046947 | A1 * | 3/2003 | Ohya et al. | 62/264 |
| 2006/0080994 | A1 * | 4/2006 | Seiden et al. | 62/441 |
| 2007/0107452 | A1 * | 5/2007 | Kim et al. | 62/264 |
| 2007/0157646 | A1 * | 7/2007 | Kim et al. | 62/187 |
| 2007/0209373 | A1 | 9/2007 | Taira et al. | |
| 2007/0266725 | A1 * | 11/2007 | Anikhindi et al. | 62/317 |

OTHER PUBLICATIONS

Toshiba Corporation, Toshiba Review 2001, vol. 56, No. 12, "'Hikari Plasma Senzohko:', Model GR-473K Refrigerator," p. 8, bearing a designation "2001".

Toshiba Corporation, "Hikari Plasma Senzohko; Model GR-473K Refrigerator," pp. 64-67, bearing a designation vol. 56, No. 12 (2001).

* cited by examiner

AIR TREATMENT SYSTEM FOR REFRIGERATED APPLIANCE

BACKGROUND

The present invention relates to an air treatment system for a refrigerated appliance. More specifically, the present invention relates to an air treatment system for a refrigerator having a removable/replaceable/rechargeable cartridge accessible from a refrigerator compartment.

Refrigerated appliances having one or more refrigerator compartments and/or freezer compartments are generally known. It is generally known to provide an air treatment systems for such appliance. Known air treatment systems typically include a purification/filtration element and a fan to force air through the purification/filtration element. Also, known systems are typically are mounted on a wall inside the food compartment of the refrigerator. However, such known air treatment systems have several disadvantages including waste of storage space, limited performance due to inadequate access to air and air flow (especially when the food storage space is relatively full), and having to pass a power cord through the refrigerator wall to power the fan. It is also known to provide a purification/filtration element that uses a combination of titanium dioxide, ultraviolet light, and ozone. However, use of ozone in such a combination tends to degrade or be harmful with the material around it and to food in the storage compartment.

Accordingly, it would be advantageous to provide an integrated air treatment system for a refrigerator. It would also be advantageous to provide an air treatment system that is integrated into the airflow upstream or downstream of the evaporator. It would further be advantageous to provide an air treatment system that only treats (e.g., purifies, filters, etc.) a portion of the air passing from the evaporator to the evaporator fan. It would further be advantageous to provide an air treatment system with a cartridge that is accessible from the food storage compartment to be removed, replaced, recharged, repaired, maintained, or the like. It would further be advantageous to provide an air treatment system with purification/filtering element that does not use ozone. It would be desirable to provide for an air treatment system having one or more of these or other advantageous features. To provide an inexpensive, reliable, and widely adaptable air treatment system that avoids the above-referenced and other problems would represent a significant advance in the art.

SUMMARY

The present invention relates to an appliance comprising an enclosure defining a cooled space; an air duct in communication with the enclosure; an evaporator configured to cool air in the air duct; a fan configured to move air between the air duct and the cooled space; and an air treatment system at least partially located in the air duct. A portion of the air passing through the air duct passes through the air treatment system and a remainder of the air passes through the air duct without passing through the air treatment system.

The present invention further relates to a refrigerated appliance comprising an enclosure defining a cooled space; an air duct in communication with the enclosure; an evaporator configured to cool air in the air duct; an evaporator fan configured to move air from the air duct into the cooled space; and an air treatment system at least partially located in the air duct and accessible from the cooled space through an access panel.

The present invention further relates to a refrigerated appliance comprising an enclosure defining a cooled space, an air duct in communication with the enclosure, a fan configured to move air from the air duct into the cooled space, and an air treatment system at least partially located in the air duct and having a cartridge configured to treat air utilizing ultraviolet light in combination with a titanium dioxide coated catalyst and without the use of ozone.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

Figure 1:
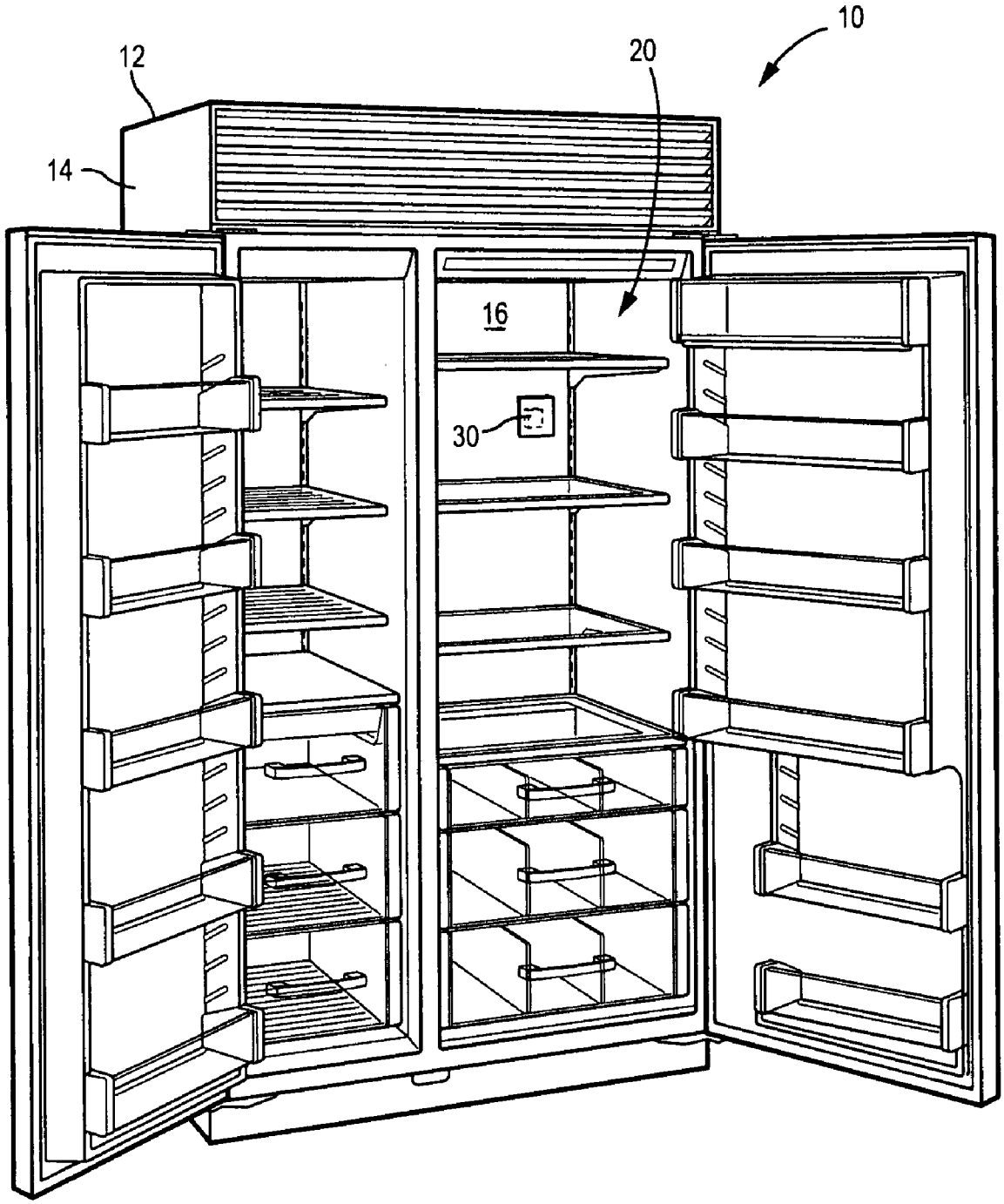
FIG. 1 is a perspective view of a refrigerator including an air purification system according to an exemplary embodiment.

Before explaining a number preferred, exemplary, and alternative embodiments of the invention in detail it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION OF THE PREFERRED AND EXEMPLARY EMBODIMENTS

FIG. 1 shows an appliance as a refrigerator 10 according to a preferred embodiment. Refrigerator 10 includes an enclosure 12, an evaporator 22, an evaporator fan 24, and an air treatment system 30. Enclosure 12 forms the main body of refrigerator 10 and includes an insulated outer wall 14 and an inner wall 16 (e.g., cold plate, etc.). Enclosure 12 may be a refrigerator component (e.g., for fresh foods) or a freezer compartment (e.g., for frozen foods). Outer wall 14 and inner wall 16 are at least partially separated by an air duct 18 (e.g., passage, space, volume, passageway, etc.). Inner wall 16 defines a cooled area or compartment 20 that is configured to receive items to be kept cooler than the outside environment. Cooled area 20 is cooled by a refrigeration system that includes at least a compressor, an evaporator 22, and a first or evaporator fan 24. According to an exemplary embodiment, evaporator 22 is disposed at least partially in air duct 18 and generally towards the bottom of enclosure 12. Evaporator fan 24 is disposed towards the top of enclosure 12 and draws air from evaporator 22, upwards through air duct 18 and into cooled compartment 20.

Figure 2:
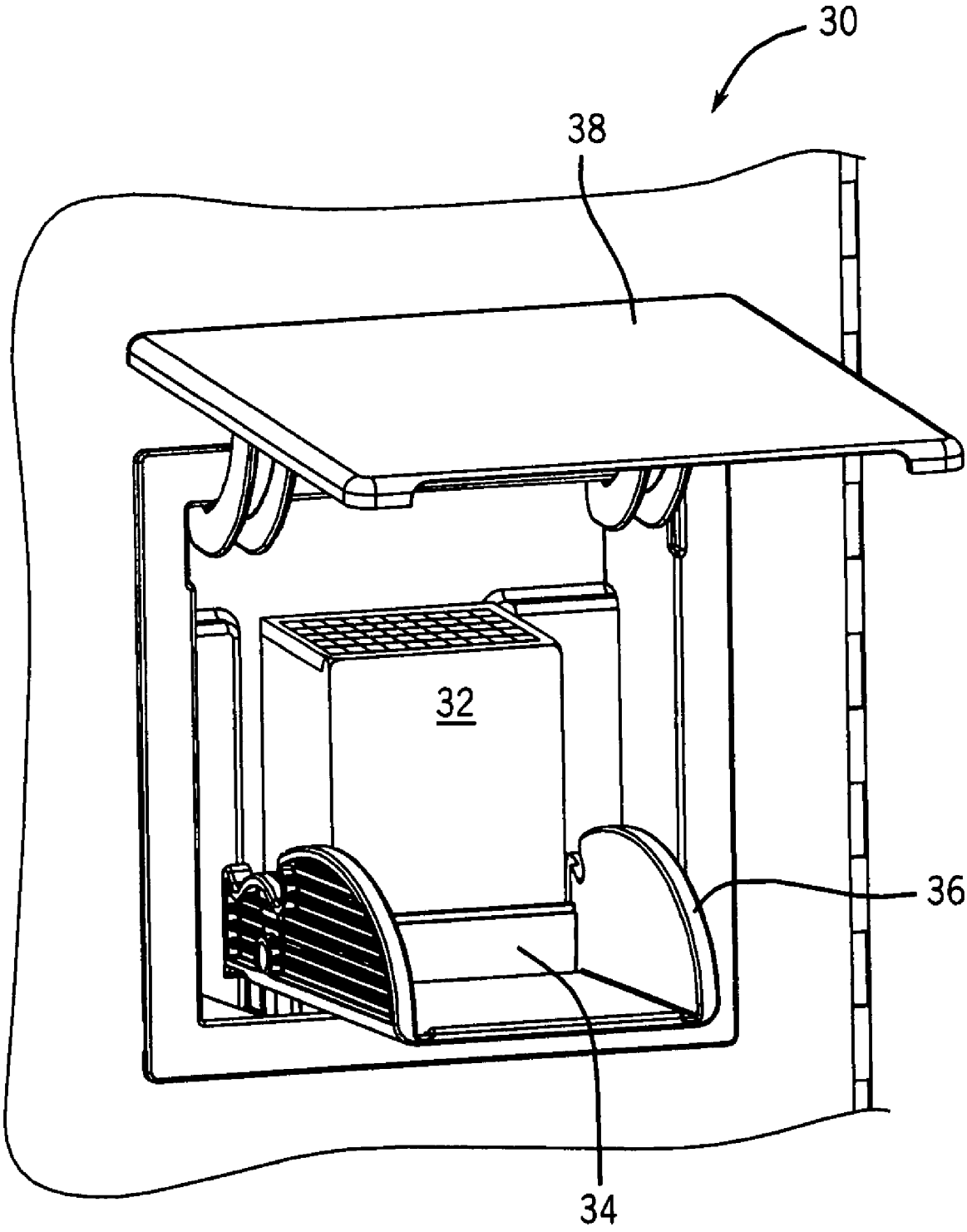
FIG. 2 is a more detailed perspective view of the air purification system in FIG. 1 in an open position according to an exemplary embodiment.

According to an exemplary embodiment, air treatment system 30 is disposed between evaporator 22 and evaporator fan 24 and at least partially within air duct 18. Air treatment system 30 is configured treat (e.g., purify, filter scrub, freshen, etc.) air inside refrigerator by oxidizing odor, bacteria, ethylene, volatile organic compounds (VOC's) or other undesirable particles without the use of ozone. According to a preferred embodiment, air treatment system 30 includes a removable filter cartridge or module 32 that is received by a base 34 with the aid of a mounting mechanism 36. A second fan 35 is provided to facilitate directing airflow into air treatment system 30. An access panel 38 is provided on inner wall 16 to allow access to air treatment system 30 from cooled compartment 20. A mounting panel 39 is coupled to outer wall 14 and provides a mounting surface for base 34 and/or other components of air treatment system 30. While air treatment system 30 is shown in FIGS. 1 and 2 as being disposed towards one side of enclosure 12 and towards the top of enclosure 12 it should be understood that air treatment system 30 may be provided in a wide variety of locations between evaporator 22 and evaporator fan 24. A majority of air treatment system 30 is disposed within air duct 18 so that it does not occupy substantial space within cooled compartment 20 or extend a substantial amount outside outer wall 14. Air treatment system 30 is shown as being located downstream of evaporator 22 (e.g., between evaporator 22 and fan 24). Alternatively, the air treatment system may be in any of a variety of locations in the airflow (e.g., upstream) and the evaporator fan may be located upstream of the evaporator (e.g., to push or blow air across the evaporator).

According to an exemplary embodiment, filter cartridge 32 is a removable member that is configured to filter or treat air passing through it. Filter cartridge 32 includes an outer housing 40 that forms a passage that is generally aligned with the air flow in air duct 18. According to an exemplary embodiment, housing 40 includes a front 80, a back, 82, a bottom 84, and a top 86. Front 80 and back 82 are generally solid members while bottom 84 and top 86 includes a plurality of slots or openings that allow air to pass through housing 40. A catalyst and a lamp 44 are disposed within housing. According to an exemplary embodiment, the catalyst (not shown) is a plurality of hollow members (e.g., pellets, pieces, tubes, etc.) that are at least partially coated with titanium dioxide ($T_iO_2$). The hollow members are large enough to be retained within housing by bottom 84 and top 86 panels.

Lamp 44 is a light source that emits ultraviolet light (e.g., UV a, UV b, UV c, etc.). According to an exemplary embodiment, lamp 44 uses a 5 Watt (W) bulb (e.g., compact fluorescent). Alternatively, the bulb may be of any variety of sizes, power outputs or the like based on the desired performance of the environment. Lamp 44 cooperates with the catalyst to purify air passing through filter cartridge. Lamp 44 is coupled to an electrical contact 46 that is provided on the bottom of filter cartridge 32. Electrical contact 46 is configured to interface with a corresponding electrical interface 52 on base 34 to provide power to lamp 44. Ultraviolet light may weaken or otherwise damage polymer materials. Housing 40 is configured to substantially enclose lamp 44 so that most of the ultraviolet light emitted by lamp 44 does not escape housing 40. Access panel 38 and/or coupling mechanism 36 are also configured (e.g., shaped, positioned, orientated, etc.) to inhibit or prevent ultraviolet light from exiting the air treatment system. Filter cartridge 32 is removable and is able to be periodically replaced. According to various exemplary embodiments, spent filter cartridges may be disposed, recycled, or recharged. According to a preferred embodiment, lamp 44 does not provide a visible light outside of cartridge 32.

Figure 3:
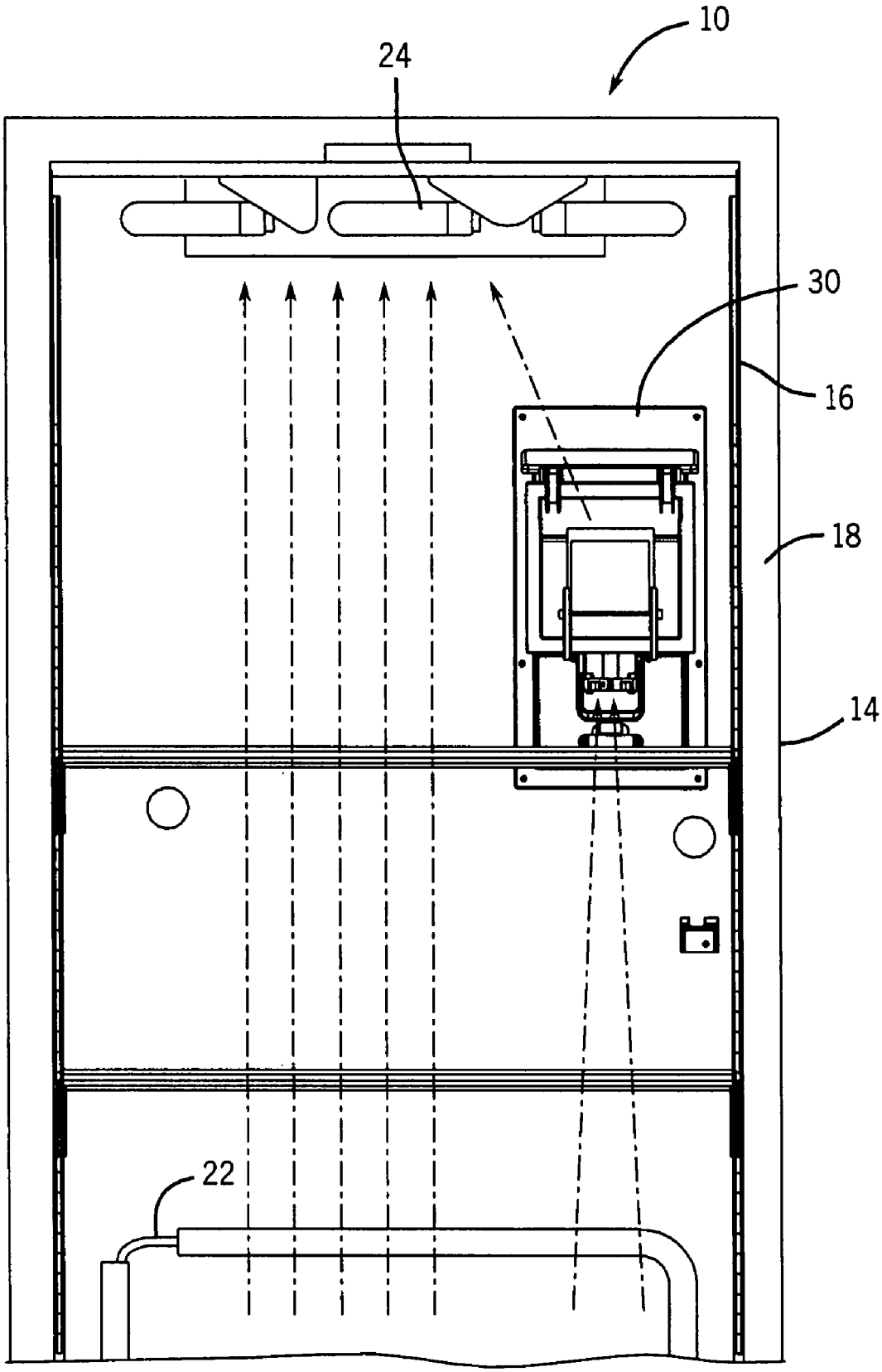
FIG. 3 is a front elevation view of a portion of the refrigerator in FIG. 1 with a portion of the inner wall hidden showing the airflow through the air duct between the evaporator and the evaporator fan according to an exemplary embodiment.
Figure 4:
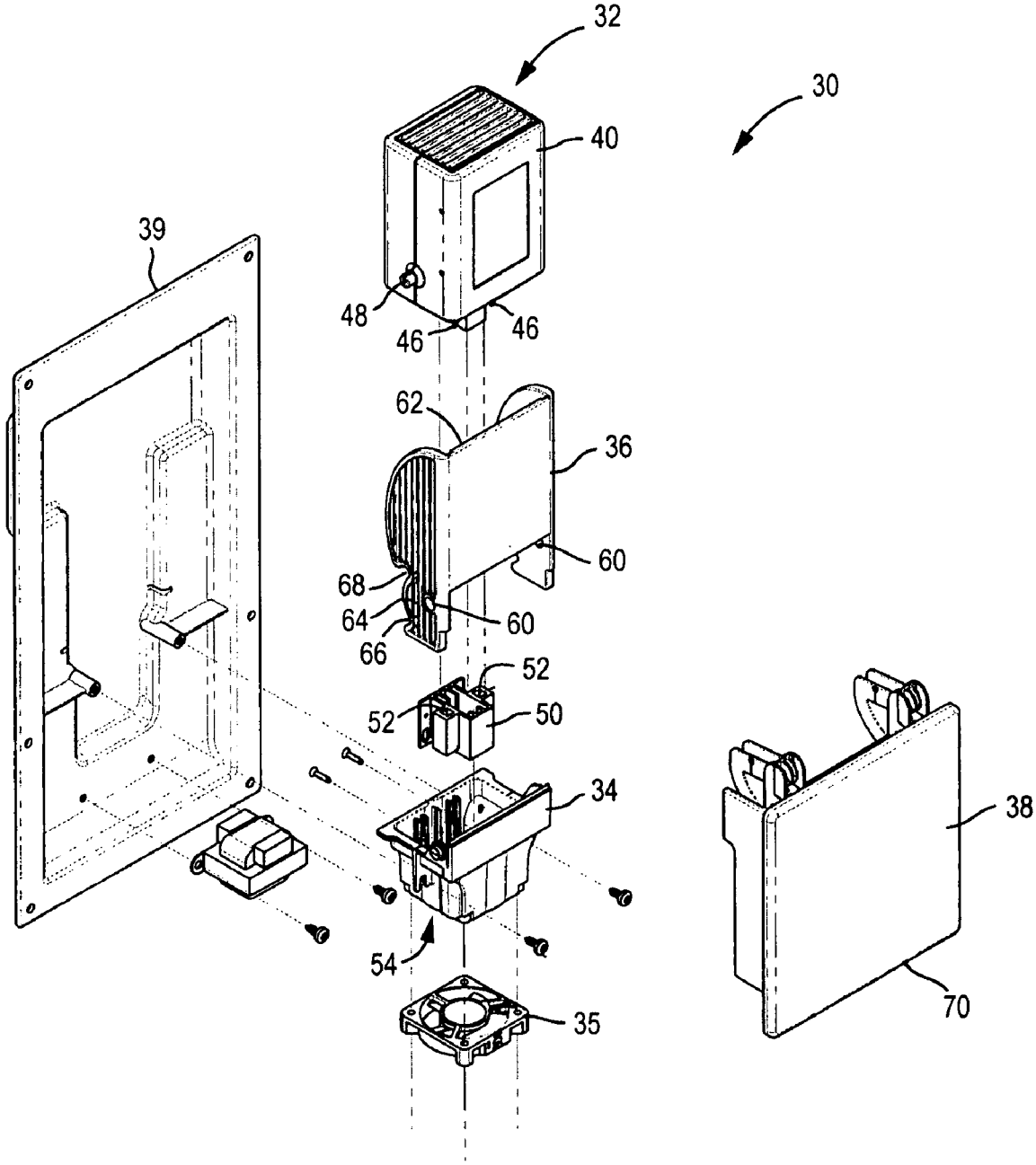
FIG. 4 is an exploded view of the air purification system in FIG. 1 according to an exemplary embodiment.
Figure 5:
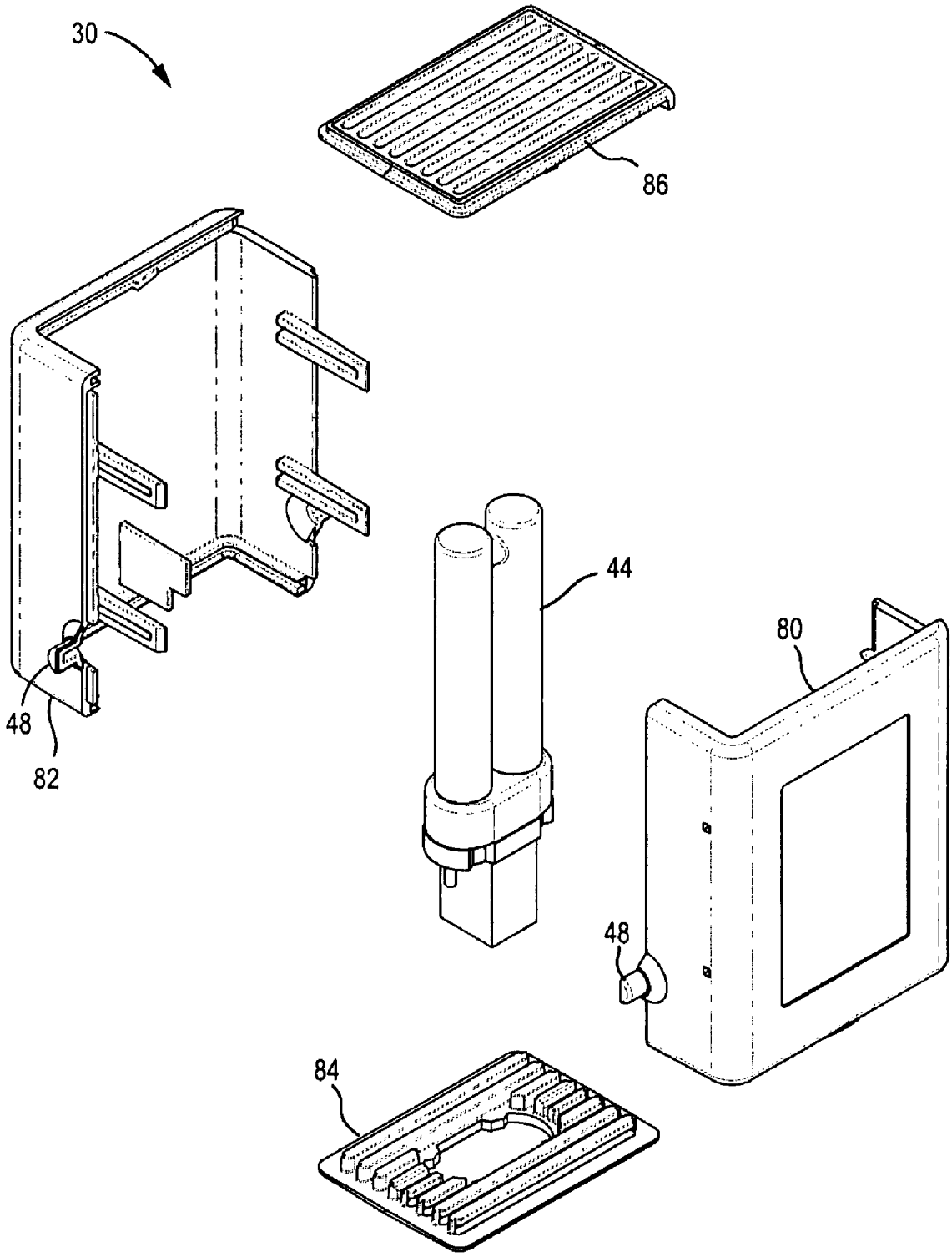
FIG. 5 is an exploded view of the filter cartridge in FIG. 4 according to an exemplary embodiment.

Filter cartridge 32 is coupled to base 34. Base 34 includes a receptacle or socket 50 that is configured to receive a portion of filter cartridge 32 and an electrical contact 52 within receptacle 50 that interfaces with electrical contact 46 to provide electrical power to lamp 44. Base 34 further forms an air duct 54 that allows air from air duct 18 to pass through base 34 and into filter cartridge 32. According to an exemplary embodiment, filter cartridge 32 is coupled to base 34 when it is fully seated within base 34. A second fan 35 is provided below base 34 to further direct air from air duct 18 into air treatment system 30. As shown in FIG. 3, air treatment system 30 only treats a portion of the air passing through air duct 18. Since air is being fairly continually circulated through air duct 18, all or substantially all of the air in refrigerator 10 will pass through air treatment system 30 over time.

Second fan 35 and base 34 are coupled to an external power source to provide electrical power to second fan 35, lamp 44, and any other components that may be included and draw electrical power (e.g., sensors, lights, etc.). According to one exemplary embodiment, electrical contacts 46 and 52 transfer electrical power between the refrigerator 10 and filter cartridge 32. According to other exemplary embodiments, the same or additional electrical contacts may transmit data between filter cartridge 32 and refrigerator 10 (e.g., data related to the life and/or performance of the filter cartridge).

A mounting or coupling mechanism 36 is provided to facilitate the coupling of filter cartridge 32 to base 34. Coupling mechanism 36 is coupled to base 34 at pivot points 60 and includes a lever 62 (e.g., release handle, lever, user interface, grip, etc.) with cam surfaces 64. Coupling mechanism 36 is moveable (e.g., pivot, rotate, swivel, swing, etc.) between a first or engaged position in which filter cartridge 32 is coupled to base 34 and a second or disengaged position in which filter cartridge 32 is released from base 34. A user may manipulate coupling mechanism 36 from cooled compartment 20 through an opening in inner wall 16 using lever 62 provided on a distal end of coupling mechanism 36 generally opposite of pivot points 60. Cam surfaces 64 are provided on coupling mechanism 36 and interface with projections 48 (e.g., protrusions, pegs, knobs, etc.) to engage and disengage filter cartridge 32 and base 34.

Figure 6A:
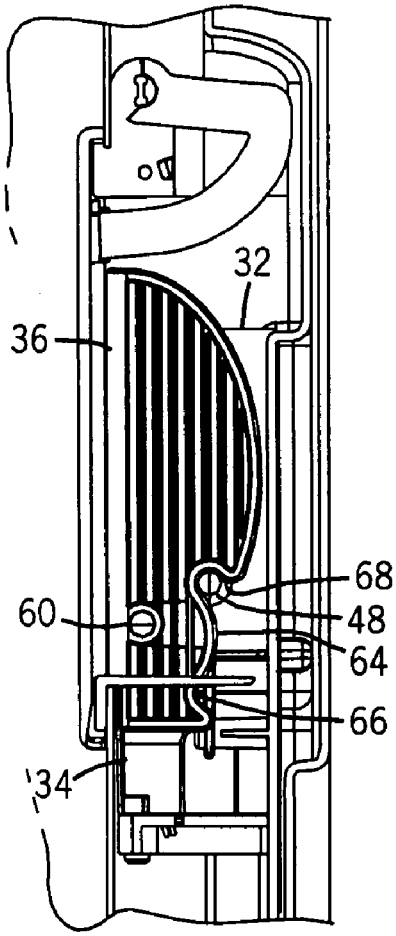
FIGS. 6A and 6B are side elevation views of the air purification system in FIG. 1 in an first or closed position and a second or open position.
Figure 6B:
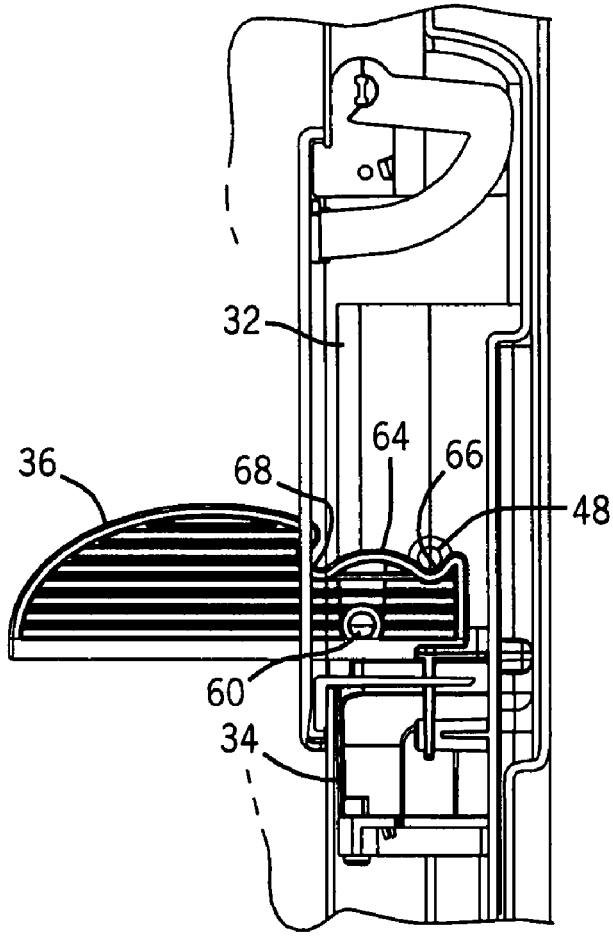
Figure 7A:
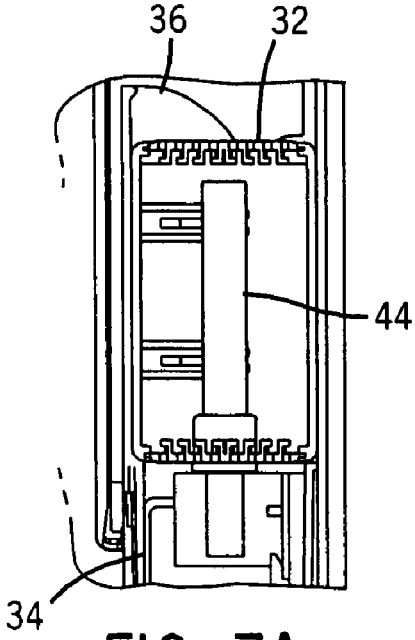
FIGS. 7A and 7B are cross-section views of the air purification system in FIG. 1 in an first or closed position and a second or open position.
Figure 7B:
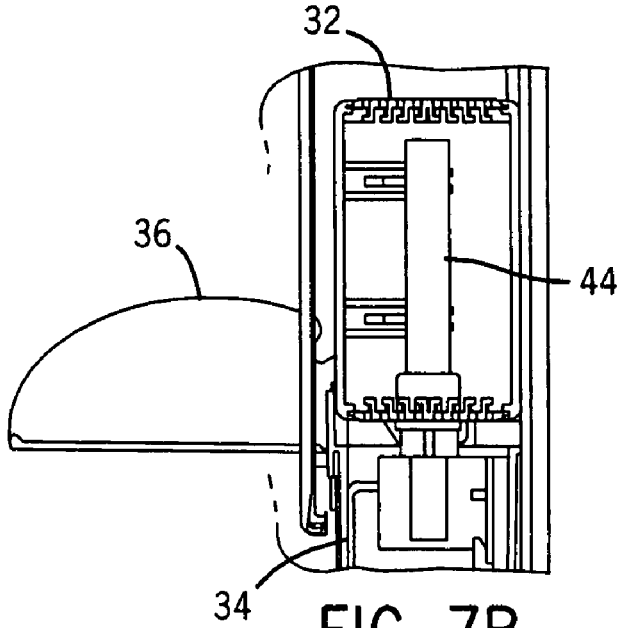

When coupling mechanism 36 is in a disengaged position (as shown in FIGS. 6B and 7B), filter cartridge 32 may be inserted into base 34. In this position, filter cartridge 32 is not coupled to base 34 and projections 48 sit in first seat 66. As coupling mechanism 36 is moved from an open position to a closed position, projections 48 ride along cam surfaces 64 until they are received in second seats 68. Filter cartridge 32 is pushed into a "snap-fit" with base 34 when coupling mechanism 36 is in a closed position and projections 48 are engaged with second seats 68 (as shown in FIGS. 6A and 7A). Coupling mechanism 36 ensures that filter cartridge is properly aligned with base 34 and fully seated in base 34 so that electrical contacts 46 and 52 are engaged. If filter cartridge 32 is not coupled properly to base 34, coupling mechanism 36 will remain in a position intermediate between the open position and closed position. This will prevent access panel 38 from closing and provide a visual indication that filter cartridge 32 is not properly installed.

To remove filter cartridge 32, a use grasps lever 62 and pulls coupling mechanism 36 to an open position. Projections 48 engage cam surfaces 64 and disengage filter cartridge 32 from base 34. When coupling mechanism 36 is in a disengaged position it lifts and presents filter cartridge 32 (e.g., to a user desiring to remove, check, replace, etc. filter cartridge 32).

Access panel 38 (e.g., door, hatch, etc.) is provided on inner surface of inner wall 16. Access panel 38 is pivotably coupled to inner wall 16 and is moveable between a first or open position in which air treatment system 30 is accessible from cooled compartment and a second or closed position in which air treatment system 30 is generally concealed from view. Access panel 38 includes an interface 70 (e.g., aperture, opening, detent, etc.) that facilitates the opening of access panel 38 by a user. According to an exemplary embodiment, access panel 38 pivots on hinges that are disposed along the upper edge of access panel 38. According to other exemplary embodiments, access panel may pivot along one of the sides or along the bottom edge.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is also important to note that the construction and arrangement of the elements of the refrigerator as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, air treatment is intended to broadly relate to a variety of conditioning of air within an appliance, including filtering, purifying, scrubbing, freshening, and the like. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. An appliance comprising:
an enclosure defining a cooled space;
an air duct in communication with the enclosure;
an evaporator configured to cool air in the air duct;
a fan configured to move air between the air duct and the cooled space; and
an air treatment system at least partially located in the air duct, wherein only a portion of the air passing through the air duct passes through the air treatment system and a remainder of the air passes through the air duct without passing through the air treatment system, the air treatment system comprising:
a filter cartridge;
a base having a receptacle configured to receive the filter cartridge;
a coupling mechanism configured to move the filter cartridge into and out of engagement with the base, the mechanism having a release handle accessible from the cooled space.

2. The appliance of claim 1 further comprising a panel movable between a closed position and an open position wherein the coupling mechanism and the cartridge are accessible from the refrigerator compartment.

3. The appliance of claim 1 wherein the cartridge comprises an ultraviolet lamp configured to irradiate ultraviolet light to the air passing through the air treatment system.

4. The appliance of claim 1 wherein the air treatment system comprises a fan configured to assist air moving through the air treatment system.

5. The appliance of claim 4 wherein the air treatment system fan draws air from the space into the air treatment system.

6. The appliance of claim 1 wherein the cartridge treats air without use of ozone.

7. The appliance of claim 1 wherein the filter cartridge includes an electrical contact that engages an electrical contact on the base for transmission of power and/or data between the cartridge and the refrigerator.

8. The appliance of claim 1 wherein the enclosure comprises an outer wall and an inner wall spaced apart from the outer wall to define the air duct.

9. The appliance of claim 1 wherein the enclosure is a refrigerator compartment or a freezer compartment.

10. A refrigerated appliance comprising:
an enclosure defining a cooled space;
an air duct in communication with the enclosure;
an evaporator configured to cool air in the air duct;
an evaporator fan configured to move air from the air duct into the cooled space; and
an air treatment system at least partially located in the air duct and accessible from the cooled space through an access panel;
wherein the air treatment system is located between the evaporator and the fan.

11. The refrigerated appliance of claim 10 wherein the air treatment system comprises;
a filter cartridge;
a base having a receptacle configured to receive the filter cartridge;
a coupling mechanism configured to move the filter cartridge into and out of engagement with the base, the mechanism having a release handle accessible from the cooled compartment.

12. The refrigerated appliance of claim 11 wherein the cartridge provides a secondary air duct for a portion of the air moving from the air duct towards the cooled space.

13. The refrigerated appliance of claim 11 wherein the coupling mechanism articulates the cartridge to ensure proper engagement and a proper seal between the cartridge and the receptacle.

14. The refrigerated appliance of claim 13 wherein the coupling mechanism includes a lever movable between an engaged position and a disengaged position.

15. The refrigerated appliance of claim 14 wherein the lever pivots between the engaged position and the disengaged position.

16. The refrigerated appliance of claim 15 wherein the lever engages the cartridge when rotated from the disengaged position to the engaged position.

17. The refrigerated appliance of claim 16 wherein the lever disengages the cartridge when moved from the first position to the second position.

18. The refrigerated appliance of claim 14 wherein the lever comprises a cam surface with a first seat and a second seat, and the cartridge includes a projection that engages the first seat when the lever is in a first position and engages the second seat when the lever is in the second position.

19. The refrigerated appliance of claim 18 wherein the cartridge is moved to a position more accessible to a user from the cooled compartment when the lever is moved from the engaged position to the disengaged position.

20. The refrigerated appliance of claim 14 wherein the cartridge is lifted to an upper position that is more accessible to a user from the cooled compartment when the lever is moved from the engaged position to the disengaged position, and is lowered to a lower position when the lever is moved from the disengaged position to the engaged position.

21. The refrigerated appliance of claim 11 wherein the cartridge includes a titanium dioxide catalyst.

22. The refrigerated appliance of claim 12 wherein the cartridge the cartridge is configured to treat air without the use of ozone.

23. The refrigerated appliance of claim 22 wherein the filter cartridge is at least one of the disposable, receivable, recyclable, rechargeable, or replaceable.

* * * * *